US009341174B2

(12) United States Patent
Endo et al.

(10) Patent No.: US 9,341,174 B2
(45) Date of Patent: May 17, 2016

(54) COMPRESSOR

(75) Inventors: Takayuki Endo, Saitama (JP); Tomoyasu Takahashi, Saitama (JP); Yoshihiro Adachi, Saitama (JP)

(73) Assignee: VALEO THERMAL SYSTEMS JAPAN CORPORATION (JP)

( * ) Notice: Subject to any disclaimer, the term of this patent is extended or adjusted under 35 U.S.C. 154(b) by 1104 days.

(21) Appl. No.: 12/452,844

(22) PCT Filed: Jul. 17, 2008

(86) PCT No.: PCT/JP2008/062883

§ 371 (c)(1),
(2), (4) Date: Jan. 25, 2010

(87) PCT Pub. No.: WO2009/014052

PCT Pub. Date: Jan. 29, 2009

(65) Prior Publication Data

US 2010/0129251 A1 May 27, 2010

(30) Foreign Application Priority Data

Jul. 26, 2007 (JP) ..... 2007-194206

(51) Int. Cl.
*F04B 27/08* (2006.01)
*F04B 39/10* (2006.01)
(Continued)

(52) U.S. Cl.
CPC ..... *F04B 27/1009* (2013.01); *F04B 27/0873* (2013.01); *F04B 39/1073* (2013.01); *F04B 53/1087* (2013.01)

(58) Field of Classification Search
CPC .... F04B 39/0027; F04B 53/10; F04B 39/108; F04B 53/1087
USPC ..... 417/570, 571, 569; 137/856, 857, 855, 137/15.18, 85
See application file for complete search history.

(56) References Cited

U.S. PATENT DOCUMENTS 3,998,571 A * 12/1976 Falke ..... 417/569
4,580,604 A * 4/1986 Kawaguchi et al. ..... 137/856
(Continued)

FOREIGN PATENT DOCUMENTS

JP 01-96479 A 4/1989
JP 04-164168 A 6/1992
(Continued)

OTHER PUBLICATIONS

International Search Report mailed on Oct. 7, 2008.

*Primary Examiner* — Charles Freay
*Assistant Examiner* — Lilya Pekarskaya
(74) *Attorney, Agent, or Firm* — Fishman Stewart PLLC

(57) ABSTRACT

A compressor that allows a discharge port to assume a large circumference and a large area at an exit end thereof so as to optimize the discharge resistance and the pressure-receiving area and assuring improved volumetric efficiency through reduced dead volume, includes a discharge port 5*b*, an entrance end of which opens into a compression chamber and an exit end that is able to open and shut with a discharge valve 43. The discharge port 5*b* is constituted with a recessed portion 50 formed to achieve a predetermined depth from the exit end and a through portion 51 having a smaller sectional area than the sectional area of the recessed portion 50. The through portion 51 is formed so that its width measured along a direction perpendicular to the longitudinal direction of the discharge valve is greater than its width measured along the longitudinal direction of the discharge valve 43.

2 Claims, 4 Drawing Sheets

(51) Int. Cl.
*F04B 53/10* (2006.01)
*F04B 27/10* (2006.01)

(56) References Cited

U.S. PATENT DOCUMENTS 4,642,037 A * 2/1987 Fritchman ..... 417/571
4,730,550 A * 3/1988 Bramstedt et al. ..... 92/240
5,035,050 A * 7/1991 Cowen ..... 29/888.02
5,213,125 A * 5/1993 Leu ..... 137/15.18
5,226,796 A * 7/1993 Okamoto et al. ..... 417/571
5,558,508 A * 9/1996 Sasano et al. ..... 417/569
5,632,609 A * 5/1997 Hashimoto ..... 417/571
5,655,898 A * 8/1997 Hashimoto et al. ..... 417/569
5,672,053 A * 9/1997 Sabha ..... 417/569
6,318,980 B1 * 11/2001 Kurihara et al. ..... 417/571
6,679,688 B2 * 1/2004 Sato et al. ..... 417/559
7,866,961 B2 * 1/2011 Masuda ..... 417/569
2001/0047833 A1 * 12/2001 Kimura et al. ..... 137/855
2005/0079081 A1 4/2005 Nieter

FOREIGN PATENT DOCUMENTS

JP 2001-342961 A 12/2001
JP 2003-1390633 5/2003
JP 2007-516378 A 6/2007
WO WO 2005/035948 A2 4/2005

* cited by examiner

COMPRESSOR

TECHNICAL FIELD

The present invention relates to a compressor that includes a discharge port with one end thereof opening into a compression chamber and another end thereof switchably closed off with a discharge valve and more specifically, it relates to a compressor with the discharge port thereof assuming a modified shape for improvement.

BACKGROUND ART

A piston-type compressor may include a cylinder block C having formed therein cylinders B through which pistons A slide reciprocally and a head E mounted at the cylinder block C via a valve plate D, as shown in FIG. 4. At the valve plate D in FIG. 4, a suction port G, with an open end thereof located on the cylinder block side opened/closed with a suction valve F, and a discharge port I, with an open end thereof located on the head side opened/closed with a discharge valve H, are formed in correspondence to each of the cylinders B.

The suction valve F and the discharge valve H, which are normally reed valves constituted with thin-plate springs having base portions thereof fixed onto the valve plate D, open/close the exit-side ends of the corresponding ports respectively in correspondence to the pressure difference between the compression chamber J and a suction chamber K and in correspondence to the pressure difference between the compression chamber J and a discharge chamber L.

As shown in the figure, discharge ports I in the related art are usually formed so as to sustain a uniform sectional shape remaining unchanged from the entrance end through the exit and (a circular section with a specific diameter). Over this area where the uniform sectional shape is sustained, a condition referred to as "dead volume" tends to occur, whereby a compressed fluid stays back instead of being let out. In addition, in a compressor assuming such a valve structure, in which the operating fluid having traveled to the discharge valve H is let out through the gap formed between the discharge valve H and the valve plate D, is prone to pressure loss. Further issues inherent to this type of compressor include surface tension attributable to the lubricating oil causing the discharge valve H to open with a delay and a lowered volumetric efficiency occurring as the residual compressed fluid remaining inside the discharge port I becomes re-expanded during a suction stroke.

The extent of loss attributable to the re-expansion may be reduced by reducing the diameter of the discharge port. However, when the discharge port assumes a smaller circumference and a smaller sectional area, the extent of pressure loss is bound to be more significant and the valve is most likely to open with a greater delay. If the diameter of the discharge port and, consequently, the circumference and the sectional area of the discharge port are increased, the pressure loss and the valve opening delay are both decreased. However, the presence of the residual compressed fluid (dead volume) in the discharge port is bound to be more significant.

In an attempt to address the issues discussed above, the compressor disclosed in patent reference literature 1 in the related art assumes a structure that assures a smooth flow of coolant and thus reduces the extent of pressure loss by forming at a discharge port at a valve plate of the compressor with an exit-side straight portion formed adjacent to an exit end of the discharge port and assuming a cylindrical shape with a uniform diameter and an entrance-side straight portion formed adjacent to an entrance end of the discharge port and assuming a cylindrical shape with a uniform diameter set smaller than the diameter of the exit-side straight portion and by forming between the exit-side straight portion and the entrance-side straight portion an enlarged diameter portion in a funnel shape, the diameter of which increases gradually toward the exit-side straight portion.

Patent reference literature 1: Japanese Unexamined Patent Publication No. 2003-1390633

DISCLOSURE OF THE INVENTION

Problems To Be Solved By the Invention

However, while the structure disclosed in the publication cited above makes it possible to reduce the extent of the pressure loss and the valve opening delay by increasing the pressure-receiving area, the dead volume in the funnel-shaped enlarged diameter portion, over which the discharge port assumes a greater volumetric capacity, cannot be fully reduced and thus, the issue of recompression of the residual compressed fluid remains a problem.

The primary object of the present invention, having been achieved by addressing the issues discussed above, is to provide a compressor that assures a greater pressure-receiving area while, at the same time, reducing the dead volume. In more specific terms, while the circumference and the opening area at the exit end of the discharge port affect the level of the discharge resistance and the size of the pressure-receiving area, the present invention primarily aims to provide a compressor with the discharge ports thereof assuming a greater circumference and a greater opening area at the exit ends thereof, which is also capable of improving the volumetric efficiency by reducing the dead volume.

Means For Solving the Problems

The inventor of the present invention et al., in their quest for fulfilling the object, found that both a greater pressure-receiving area and a reduction in the dead volume can be achieved at once by eliminating the tapered (funnel-shaped) enlarged diameter portion a large section at the exit end of the discharge port with a similar flow passage section sustained over the area preceding the large section and the area thereof gradually increasing toward the exit side, and the present invention has been completed based upon this finding.

Namely, the compressor according to the present invention, having a discharge port, an entrance end of which opens into a compression chamber and an exit end of which is able to open and shut with a discharge valve (switchably closed off by a discharge valve), wherein said discharge port includes a recessed portion formed to achieve a predetermined depth from the exit end and a through portion that has a sectional area smaller than the sectional area of the recessed portion, with one end thereof opening at the recessed portion and another end thereof opening into the compression chamber.

Since the discharge port is constituted with a recessed portion and a through portion with a smaller passage sectional area, a large opening area, comparable to that in the related art, can be assured at the exit end with the recessed portion, making it possible to prevent an increase in the pressure loss or an increase in the valve opening delay, attributable to a small opening area at the exit end. In addition, since the through portion with a smaller passage section is formed continuously to the recessed portion without forming an enlarged diameter portion, which gradually increases its passage section area toward the recessed portion, between the recessed portion and the through portion, the quantity of residual compressed fluid remaining in the discharge port can be greatly reduced.

It is desirable that the shapes of the sectional shapes of the recessed portion and the through portion remain uniform along the axial direction in order to facilitate formation of the discharge port and control of the dead volume. In other words, the recessed portion should assume a flat shape so as not to form any funnel-shaped portion where the sectional shape changes gradually. In addition, it is desirable to form the through portion by ensuring that its width measured along a direction substantially perpendicular to the longitudinal direction of said discharge valve (the longer side of the discharge valve) is greater than its width measured along the longitudinal direction of said discharge valve (the longer side of the discharge valve), so as to allow the compressed gas to be let out smoothly without creating any significant dead volume.

Furthermore, the recessed portion may be formed by ensuring that its circumferential edge does not overlap the circumferential edge of the through portion so as to allow the gas to be let out smoothly. When through portion is divided into two parts, i.e., said front-end side and a base side, relative to a straight line extending perpendicular to the longitudinal direction of said discharge valve and passing through center of said recessed portion, the through portion may be formed at a position at which the area of the front-end side is greater than the area of a base side so as to allow the gas to be let out smoothly.

While the structure described above may be adopted in any compressor assuming a valve structure whereby each discharge port through which the compressed gas is let out is opened/closed at its exit end via a switching valve, it is particularly effective when adopted in a piston-type compressor comprising a compression chamber, the volumetric capacity of which is altered with a piston, a suction chamber and a discharge chamber separated from the compression chamber via a valve plate, a suction port located at the valve plate, which communicates between the compression chamber and the suction chamber, a discharge port located at the valve plate, which communicates between the compression chamber and the discharge chamber, and reed valves that individually open/close the suction port and the discharge port at exit ends thereof.

Effect of the Invention

As described above, the discharge port according to the convention is constituted with a recessed portion formed so as to assume a specific depth from the exit end and a through portion with a sectional area smaller than the sectional area of the recessed portion, one end of which opens at the recessed portion and another end of which opens into the compression chamber. Thus, while the circumference and the opening area of the discharge port at the exit end thereof affect the level of the discharge resistance and the size of the pressure-receiving area, the discharge port is allowed to assume a large circumference and a large opening area at the exit end thereof while keeping down the dead volume, thereby making it possible to reduce the extent of pressure loss and the extent of valve opening delay.

In addition, the recessed portion and the through portion in the structure described above, sustaining uniform sectional shapes along the axial direction, can be easily formed through cutting or press machining and the depth of the recessed portion can easily be adjusted to an optimal value in consideration of the dead volume, thereby facilitating control of the dead volume. Moreover, the through portion can be formed at any position relative to the position of the recessed portion.

By setting the dimension of the through portion of the discharge port, measured along the direction substantially perpendicular to the longer side of the discharge valve, to a value greater than the dimension of the through portion measured along the longer side of the discharge valve, the circumference of the discharge port can be increased without increasing the dead volume and the compressed gas can thus be let out smoothly.

In addition, by ensuring that the circumferential edge of the recessed portion does not overlap the circumferential edge of the through portion or by forming the through portion on the side further away from the base end of the discharge valve relative to the center of the recessed portion, smooth discharge of the gas can be assured.

EXPLANATION OF REFERENCE NUMERALS

3, 5 valve plate
3*a*, 5*a* suction port
3*b*, 5*b* discharge port
18 compression chamber
27*a*, 27*b* suction chamber
28*a*, 28*b* discharge chamber
43 discharge valve
50 recessed portion
51 through portion

BEST MODE FOR CARRYING OUT THE INVENTION

The following is a description of the best mode for carrying out the invention given in reference to the attached drawings.

Figure 1:
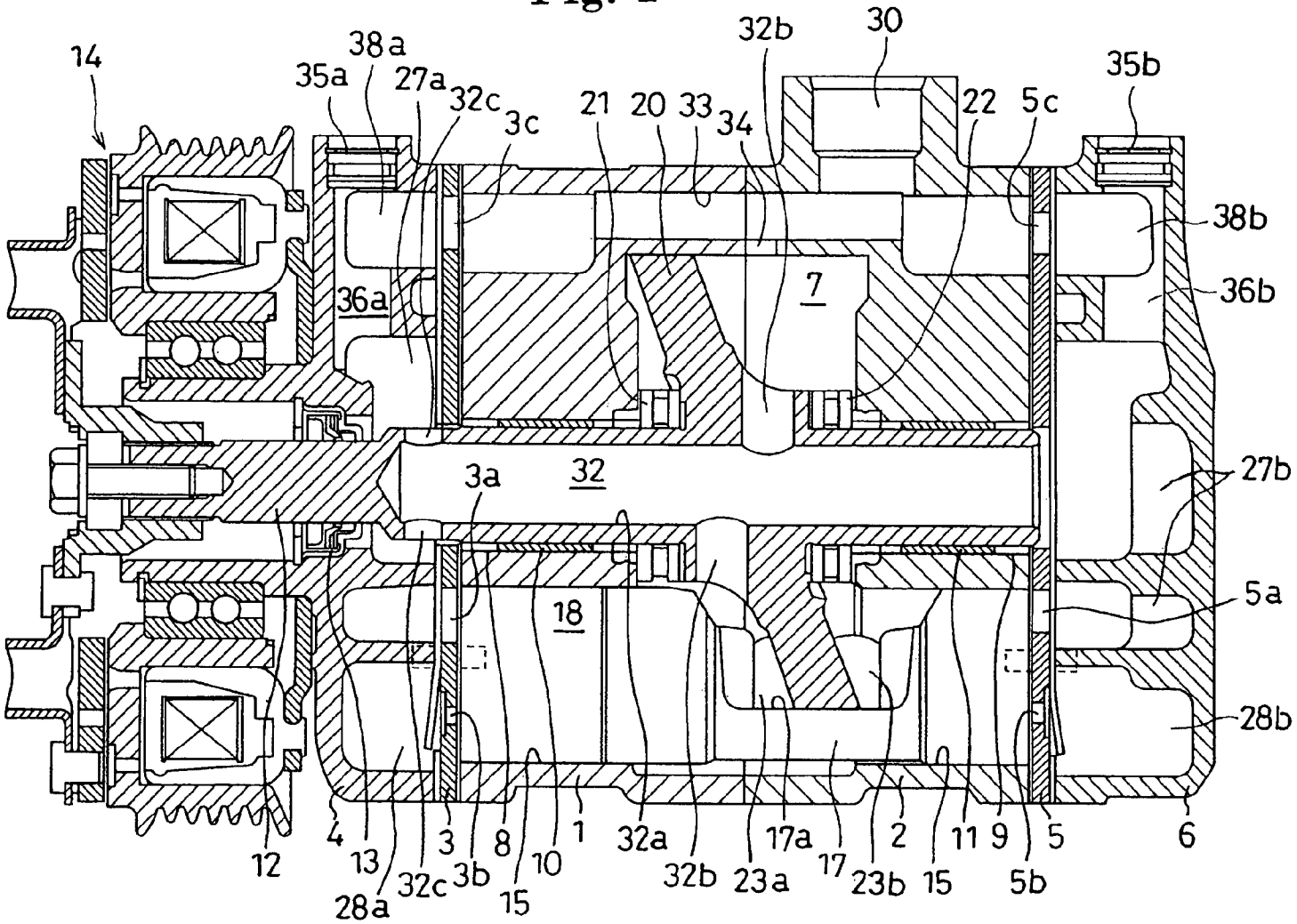
FIG. 1 is a sectional view presenting an example of a structure that may be adopted in the piston-type compressor according to the present invention.

The piston-type compressor in FIG. 1, representing an example of the compressor according to the present invention, is a fixed-capacity swash plate reciprocating compressor engaged in operation in a refrigerating cycle in which a coolant is used as an operating fluid.

The compressor comprises a front-side cylinder block 1, a rear-side cylinder block 2 attached to the front-side cylinder block 1, a front head 4 mounted via a valve plate 3 onto the front side (the left side in the figure) of the front-side cylinder block 1 and a rear head 6 mounted via a valve plate 5 onto the rear side (the right side in the figure) of the rear-side cylinder block 2. The front head 4, the front-side cylinder block 1, the rear-side cylinder block 2 and the rear head 6 fastened together along the axial direction with a fastening bolt, constitute a housing for the compressor as a whole.

As the front-side cylinder block 1 and the rear-side cylinder block 2 are attached to each other, a crankcase 7 is defined within the cylinder block assembly. A shaft 12, rotatably supported via bearings 10 and 11 at shaft support holes 8 and 9 respectively formed in the front-side cylinder block 1 and the rear-side cylinder block 2 with one end thereof projecting out beyond the front head 4, is disposed in the crankcase 7. The bearings 10 and 11 are mounted at positions at which they do not block the openings of side holes formed at a shaft internal passage to be detailed later. In addition, a seal member 13 is disposed between the front end of the shaft 12 and the front head 4 so as to prevent leakage of the coolant, and an electromagnetic clutch is installed at the front end of the shaft 12 projecting out beyond the front head 4.

A plurality of cylinders 15, ranging parallel to the shaft support holes 8 and 9 and set over equal intervals on the circumference of a circle centered on the shaft, are formed in the cylinder blocks 1 and 2. A double-ended piston 17 with a head portion formed at each end thereof is inserted in each cylinder 15 so as to reciprocally slide inside the cylinder and a compression chamber 18 is formed between the double-ended piston 17 and the valve plate 3 and between the double-ended piston 17 and the valve plate 5.

A swash plate 20 that is housed inside the crankcase 7 and rotates together with the shaft 12 is formed as an integrated part of the shaft 12. The swash plate 20 is rotatably supported via thrust bearings 21 and 22 so as to rotate freely relative to the front-side cylinder block 1 and the rear-side cylinder block 2. Its edge is retained at a recessed retainer portion 17*a* formed at a central area of each double-ended piston 17 via a pair of semi-spherical shoes 23*a* and 23*b* disposed so as to hold the swash plate on its front side and its rear side. Thus, as the shaft 12 rotates causing the swash plate 20 to rotate, this rotation is converted to a reciprocal motion of the double-ended piston 17 via the shoes 23*a* and 23*b*, thereby causing the volumetric capacity of the compression chamber 18 to change.

A suction port 3*a*, which is opened/closed with a suction valve disposed at the end surface located toward the cylinder block, and a discharge port 3*b* opened/closed with a discharge valve disposed at the end surface located toward the cylinder head are formed in correspondence to each cylinder at the valve plate 3, whereas a suction port 5*a*, which is opened/closed with a suction valve disposed at the end surface located toward the cylinder block and a discharge port 5*b* opened/closed with a discharge valve disposed at the end surface located toward the cylinder head are formed in correspondence to each cylinder at the valve plate 5. In addition, a suction chamber 27*a* where the coolant to be delivered into the compression chamber 18 is stored and a discharge chamber 28*a* where the coolant let out from the compression chamber 18 is stored are formed at the front head 3, whereas a suction chamber 27*b* where the coolant to be delivered into the compression chamber 18 is stored and a discharge chamber 28*b* where the coolant let out from the compression chamber 18 is stored are formed at the rear head 6. In this example, the suction chambers 27*a* and 27*b* are formed at substantial centers of the respective heads 4 and 6, with the discharge chambers 28*a* and 28*b* formed around the suction chambers 27*a* and 27*b* respectively.

In addition, an intake 30 through which the coolant is taken in from an external cycle and a discharge port (not shown) communicating with the discharge chambers 28*a* and 28*b*, through which the compressed coolant is let out, are formed at the rear-side cylinder block 2 constituting the housing.

The intake paths extending from the intake 30 to the suction chambers 27*a* and 27*b* in this structural example include a first intake path which passes through the crankcase 7 communicating with the intake 30 and through a shaft internal passage 32 formed in the shaft 12 ranging through the crankcase 7 before reaching the suction chambers 27*a* and 27*b* at the front head 4 and the rear head 6 respectively and a second intake path through which the coolant having flowed in through the intake 30 is directly guided to the suction chambers 27*a* and 27*b* without traveling through the crankcase 7.

In more specific terms, an axial passage 33 connecting with the intake 30 and extending along the axial direction is formed outside the crankcase 7. The first intake path is formed by forming a through portion 34 that communicates with the crankcase 7 at the axial passage 33 and by forming within the shaft 12 an axial hole 32*a* bored from the rear-side end toward the front side along the axial direction with the rear side open end thereof opening into the suction chamber 27*b* located at the rear head 6, an inflow side hole 32*b* communicating with the axial hole 32*a* ranging along the radius of the shaft 12 and opening into the crankcase 7, and an outflow side hole 32*c* communicating with the axial hole 32*a*, ranging along the radius of the shaft 12 and opening it to the suction chamber 27*a* located at the front head 4, so as to guide part of the coolant taken in through the intake 30 into the crankcase 7 via the through portion 34 and then guide it via the axial hole 32*a*, the intake side hole 32*b* and the outflow side hole 32*c* constituting the shaft internal passage 32, into the suction chambers 27*a* and 27*b* located at the front and the rear of the compressor through the shaft 12.

The second intake path, on the other hand, is formed by extending the axial passage 33 formed outside the crankcase 7 through the front head 4 and the rear head 6, setting it in communication with delivery chambers 38*a* and 38*b* respectively formed at the front head 4 and the rear head 6 via through portions 3*c* and 5*c* formed at the respective valve plates 3 and 5, by forming radial passages 36*a* and 36*b* respectively at the front head 4 and the rear head 6, bored from the outside along the radial direction so as not to interfere with the discharge chambers 28*a* and 28*b* with open ends thereof respectively closed off with blocking members 35*a* and by 35*b* and connecting the delivery chambers 38*a* and 38*b* with the suction chambers 27*a* and 27*b* respectively through the radial passages 36*a* and 36*b*, so as to guide part of the coolant having been taken in through the intake 30 directly into the suction chambers 27*a* and 27*b* located at the front and the rear of the compressor without taking it through the crankcase 7.

Figure 2B:
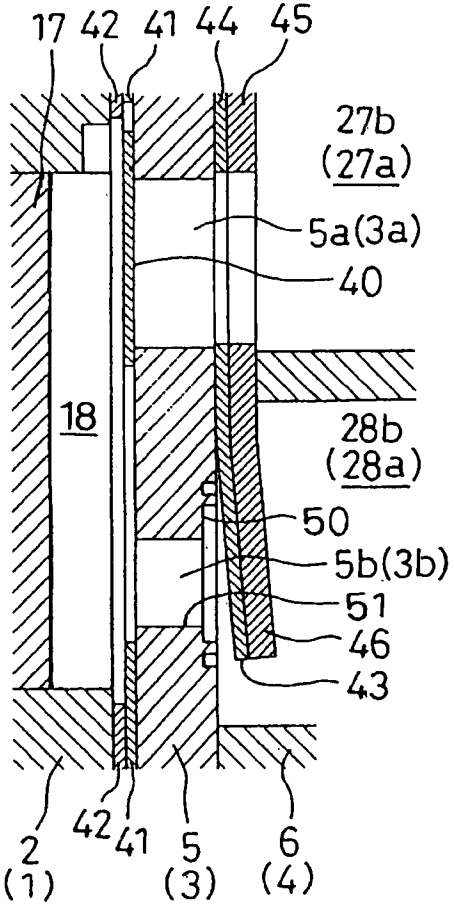
FIG. 2 illustrates the valve mechanisms disposed at the valve plate in the compressor according to the present invention, with FIG. 2(*a*) showing the valve plate viewed from the discharge side and FIG. 2(*b*) showing the valve mechanisms at the valve plate in an enlarged sectional view.
Figure 2A:
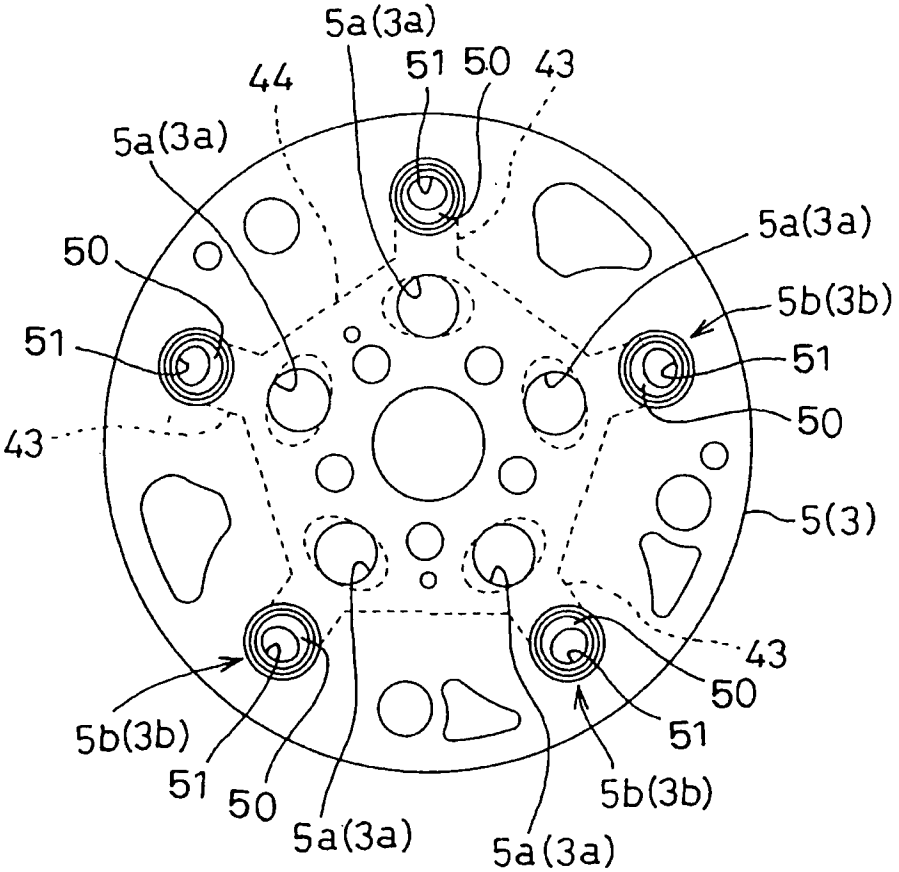

FIG. 2 illustrates a specific structure that may be adopted for the valve mechanisms formed at the valve plates of the compressor described above. While the figure shows the rear-side valve mechanisms, a similar structure is adopted for the front-side valve mechanisms and accordingly, the corresponding portions of the front-side valve mechanisms are indicated by the reference numerals in the parentheses.

The intake-side valve mechanism is formed by layering a suction valve sheet 41 with suction valves 40 formed as an integrated part thereof onto the cylinder block-side end surface of the valve plate 5 (3) and then layering the cylinder block 2 (1) onto the suction valve sheet 41 via a gasket 42. Suction ports 5*a* (3*a*) formed at the valve plate 5 (3) are switchably closed off with the suction valves 40.

The suction valves 40, which are reed valves each constituted with a thin plate spring with the base portion thereof formed as an integrated part of the suction valve sheet 41, are flexibly held as the suction valve sheet 41 is held between the valve plate 5 (3) and the gasket 42. As a result, the suction valves 40 are each made to open/close the exit end of the corresponding suction port 5*a* (3*a*) in correspondence to the difference between the pressure in the compression chamber and the pressure in the suction chamber when the compressor operates.

The discharge-side valve mechanism is formed by layering a discharge valve sheet 44 with discharge valves 43 formed as an integrated part thereof onto the head-side end surface of the valve plate 5 (3) and then layering the head 6 (4) onto the discharge valve sheet 44 via a gasket 45. Discharge ports 5*b* (3*b*) formed at the valve plate 5 (3) are switchably closed off with the discharge valves 43.

The discharge valves 43, which are also reed valves each constituted with a thin plate spring with the base portion thereof formed as an integrated part of the discharge valve sheet 44, are flexibly held as the base portions are held between the valve plate 5 (3) and the gasket 45. As a result, the discharge valves 43 are each made to open/close the exit end of the corresponding discharge port 5*b* (3*b*) in correspondence to the difference between the pressure in the compression chamber and the pressure in the discharge chamber when the compressor operates.

The cylinder block 2 (1), the gasket 42, the suction valve sheet 41, the valve plate 5 (3), the discharge valve sheet 44 and the gasket 45 described above are positioned by using positioning pins (not shown) and are locked together as they are pressed into contact with one another with bolts threaded through the cylinder block.

When the exit end of each discharge port 5*b* (3*b*) is closed off, the corresponding discharge valve 43 in its entirety comes into tight contact with the surface of the valve plate 5 (3) with the front end of the discharge valve contacting the circumferential edge of the exit end of the discharge port 5*b* (3*b*). The exit end of the discharge port 5*b* (3*b*) is opened as the front end flexes and the discharge valve thus partially separates itself from the valve plate 5 (3). The lift quantity representing the extent by which the separated discharge valve 40 is lifted, i.e., the extent by which the exit end of the discharge port 5*b* (3*b*) becomes opened, is controlled with a retainer 46 formed as an integrated part of the gasket 45.

Discharge ports 5*b* (3*b*) are distinguishable in their shape from those in the related art in that they are each constituted with a recessed portion 50 formed so as to achieve a specific depth from the exit end and a through portion 51 assuming a smaller sectional area than the sectional area of the recessed portion 50 with one and thereof opening at the recessed portion 50 and another end thereof opening into the compression chamber 18. The recessed portion 50 and the through portion 51 are formed perpendicular to the end surface of the valve plate 5 (3), and the recessed portion and the through portion each sustain a uniform sectional shape that remains unchanged along the axis of the discharge port. In other words, the recessed portion 50 sustains a flat section instead of assuming a funnel-shaped section, the diameter of which gradually changes.

Figure 3A:
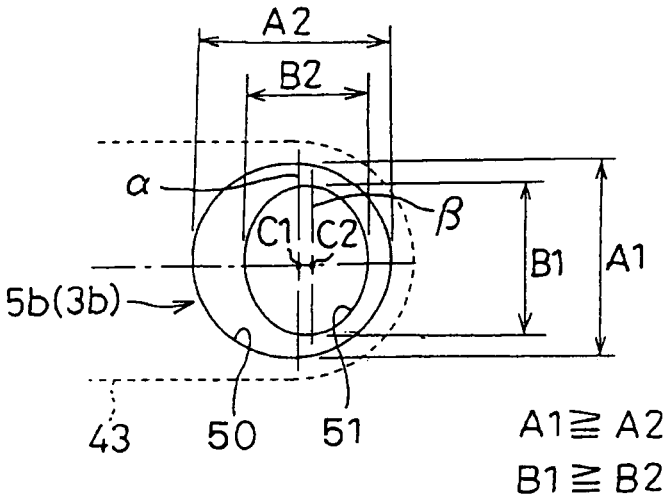
FIG. 3 shows discharge ports in enlargements, with FIG. 3(*a*) showing a discharge port with the recessed portion and the through portion thereof each formed in an elliptical shape and FIG. 3(*b*) showing a discharge port with the recessed portion and the through portion thereof each formed in a rectangular shape.
Figure 3B:
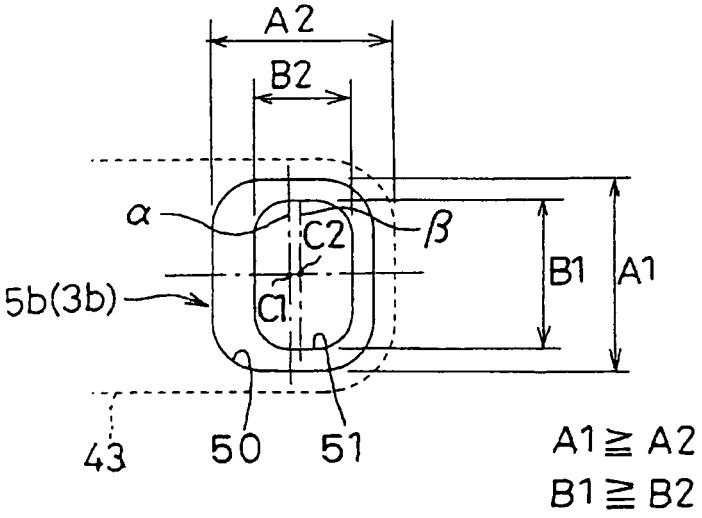
Figure 4:
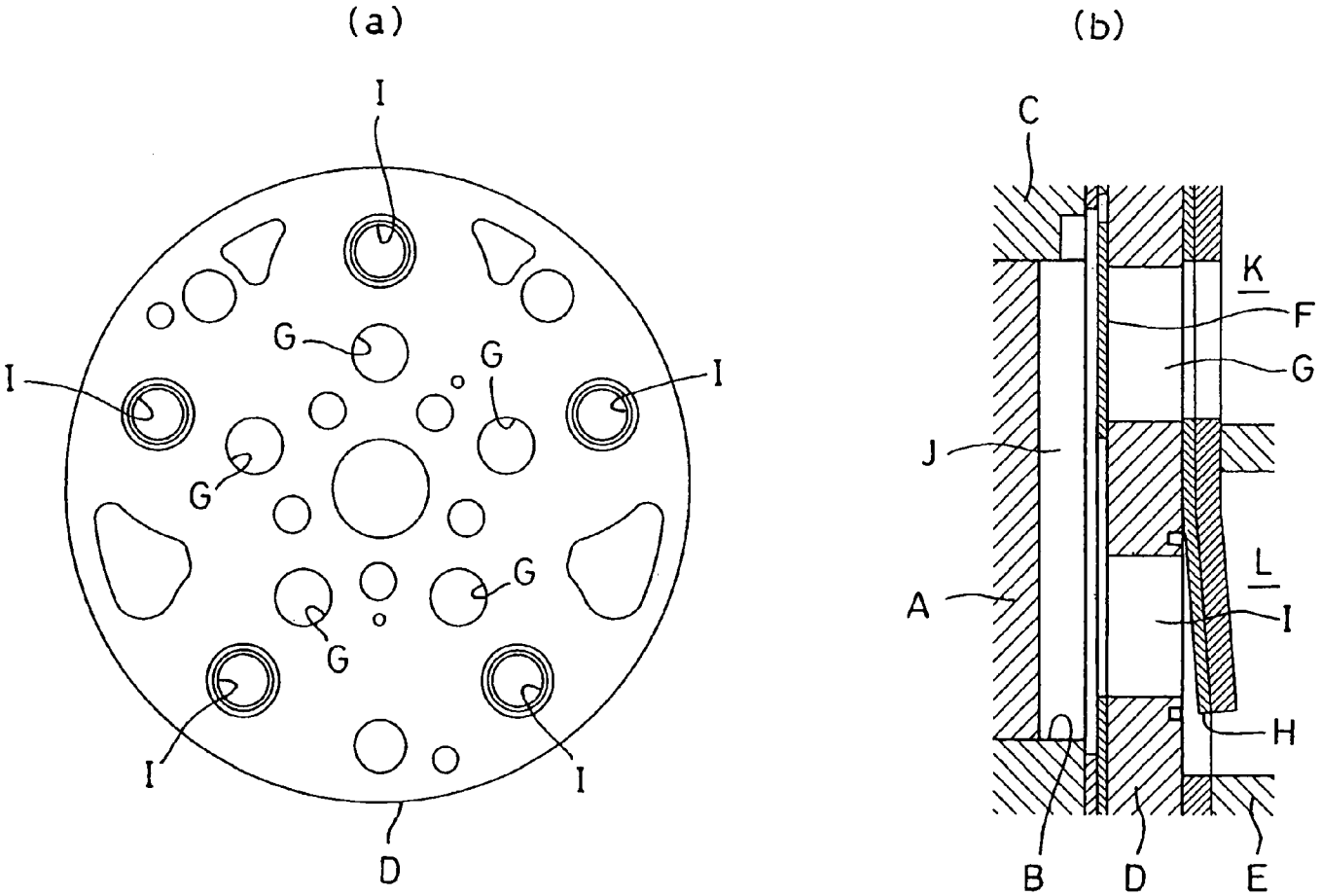
Fig. 4 (Prior Art)
FIG. 4 illustrates the valve mechanisms disposed at a valve plate in a compressor in the related art, with FIG. 4(*a*) showing the valve plate viewed from the discharge side and FIG. 4(*b*) showing the valve mechanisms at the valve plate in an enlarged sectional view.

In addition, as shown in FIG. 3(*a*), the recessed portion 50 and the through portion 51 are formed so that their widths (the width A1 of the recessed portion 50 and the width B1 of the through portion 51) measured along a direction substantially perpendicular to the longer side of the discharge valve 43 are respectively equal to or greater than the widths (the width A2 of the recessed portion 50 and the width B2 of the through portion 51) measured along the longer side of the discharge valve 43 (A1≥A2, B1≥B2). In the example presented in FIG. 3(*a*), the recessed portion and the through portion are each formed in an elliptical shape, the major axis of which extends perpendicular to the axis of the discharge valve 43. It is to be noted that the recessed portion 50 and the through portion 51 may instead be formed so that their sections each form a rectangular shape, the longer side of which extends perpendicular to the longer side of the discharge valve 43, as shown in FIG. 3(*b*).

In addition, the recessed portion 50 is formed by ensuring that its circumferential edge does not overlap the circumferential edge of the through portion 51 but instead the recessed portion is formed so that its circumferential edge is present further outside along the radial direction relative to the circumferential edge of the through portion 51. Furthermore, the through portion 51 is formed by offsetting its center C2 toward the front end of the discharge valve 43 relative to a center C1 of the recessed portion 50 so that when the through portion is divided into two parts, i.e., a front end side and a base side, with a straight line α extending perpendicular to the longer side of the discharge valve 43 and passing through the center C1 of the recessed portion 50, the area of the front end side is greater than the area of the base side (a straight line beta which divides the through portion 51 into two parts with equal areas in correspondence to the front and sides and base side of the discharge valve 43 is offset toward the front end side relative to the straight line α).

The structure described above, in which the discharge port 5*b* (3*b*) is constituted with the recessed portion 50 assuming a specific depth measured from the exit end and the through portion 51 assuming a smaller sectional area than the sectional area of the recessed portion 50 assures via the recessed portion 50 a significant opening area at the exit end, comparable to that in the related art, thereby making it possible to prevent or reduce the extents of pressure loss and valve opening delay attributable to a small opening area at the exit end. In addition, since the compression chamber and the recessed portion 50 are set in communication with each other via the through portion 51 with a smaller passage section, the residual compressed fluid (dead volume) remaining in the discharge port 5*b* (3*b*) can be greatly reduced.

While the circumference and the opening area of the discharge port 5*b* (3*b*) at the exit end affect the level of discharge resistance and the pressure-receiving area, the structure described above allows the discharge port to assume a greater circumference and a greater opening area at its exit while keeping down the dead volume, which, in turn, makes it possible to reduce the extent of pressure loss and the extent of valve opening delay.

In addition, since the shapes of the sections of the recessed portion 50 and the through portion 51 both remain unchanged along the axial direction and a funnel-shaped enlarged diameter portion, the sectional area of which gradually changes, is not formed, the recessed portion 50 and the through portion 51 can be formed with great ease either through cutting or press machining. Furthermore, since the depth of the recessed portion 50 can be set by factoring in the dead volume, the dead volume can be controlled with ease. Since no funnel-shaped enlarged diameter portion needs to be formed, the recessed portion 50 and the through portion 51 do not need to be concentric to each other and thus, the through portion 51 is allowed to assume any position relative to the position of the recessed portion 50.

Moreover, since the through portion 51 at the discharge port 5*b* (3*b*) is formed so that its width measured along a direction substantially perpendicular to the longer side of the discharge valve 43 is greater than its width measured along the longer side of the discharge valve 43, the circumference of the discharge port can be increased without resulting in a significant dead volume and the compressed gas can thus be let out smoothly.

In addition, since the recessed portion 50 is formed by ensuring that its circumferential edge does not overlap the circumferential edge of the through portion 51 and the through portion 51 is formed with an offset toward the front end of the discharge valve 43 relative to the center (C1) of the recessed portion 50, a smooth output of the gas is assured.

It is to be noted that while present invention is adopted in a piston-type fixed-capacity compressor equipped with double-ended pistons, a similar structure may be adopted in a compressor other than that described above, e.g., a piston-type compressor equipped with single-ended pistons, a variable capacity compressor or a non-piston-type compressor, as long as the compressor includes a discharge port through which a compressed fluid is let out and a discharge valve that switchably closes off the exit end of the discharge port.

The invention claimed is:

1. A compressor, comprising:

a flat valve plate extending radially outwardly along a radial axis from a valve plate center point; and a discharge valve operably connected to the flat valve plate, wherein the flat valve plate has opposing parallel flat surfaces and a discharge port formed therethrough between the opposing parallel flat surfaces, an entrance end of which opens into a compression chamber and an exit end of which is configured to be opened and shut with the discharge valve, wherein the discharge valve is a reed valve comprising at least one flexible finger extending along the radial axis and away from the valve plate center point, wherein the discharge port is formed with a non-tapered recessed portion extending partially into the flat valve plate from the exit end to define a non-tapered recessed opening and a non-tapered through portion extending partially into the flat valve plate from the entrance end to define a non-tapered through opening, the non-tapered recessed opening and the non-tapered through opening being in fluid communication with each other and sized to form a stepped-down landing interiorly of the flat valve plate extending parallel to and between the opposing parallel flat surfaces where the non-tapered through opening and the non-tapered recessed opening interface one another and wherein the non-tapered through opening extends outwardly from and about a through opening center point and the non-tapered recessed opening extends outwardly from and about a recessed opening center point, wherein the through opening center point and the recessed opening center point are disposed on the radial axis in an offset manner such that recessed opening center point is located closer to the valve plate center point than the through opening center point, wherein the stepped-down landing has an arcuate narrow segment including a narrowest portion and an arcuate broad segment including a broadest portion, the arcuate narrow segment and the arcuate broad segment connected together to form a continuous loop and wherein respective ones of the narrowest and the broadest portions extend along the radial axis with the broadest portion being disposed between the narrowest portion and the valve plate center point.

2. A compressor according to claim 1, wherein the reed valve is operative between an open state and a closed state such that, in the closed state, the discharge valve and the valve plate are in facial contact with each other to define a common plane therebetween as viewed in cross-section.

* * * * *